US006428642B1

(12) United States Patent
Matthews et al.

(10) Patent No.: US 6,428,642 B1
(45) Date of Patent: Aug. 6, 2002

(54) TRANSVERSE DIRECTIONAL ZIPPER WITH A DOUBLE SEAL FLANGE PROFILE CONFIGURATION

(75) Inventors: David J. Matthews, Gilman; Eric P. Plourde, Homewood, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/524,349

(22) Filed: Mar. 13, 2000

(51) Int. Cl.[7] ..... A41H 37/00

(52) U.S. Cl. ..... 156/66; 156/218; 493/213

(58) Field of Search ..... 156/218, 66; 493/213

(56) References Cited

U.S. PATENT DOCUMENTS 4,528,224 A 7/1985 Ausnit
6,017,412 A * 1/2000 Van Erden et al. ..... 156/66

* cited by examiner

*Primary Examiner*—John J. Gallagher
(74) *Attorney, Agent, or Firm*—Pitney, Hardin, Kipp & Szuch LLP

(57) ABSTRACT

A vertical form fill and seal apparatus is used to manufacture reclosable containers. A plastic zipper segment is provided with a double seal flange configuration wherein two zippers are provided for adjacent reclosable containers, one reclosable container being upside down and the other being rightside up. The zipper segment is initially provided on the web with the first flange sealed to the web. A tube is formed so that lateral edges are folded over and sealed to the second flange. A cut is thereafter formed by the sealing bars to separate the two reclosable containers from each other.

7 Claims, 5 Drawing Sheets

TRANSVERSE DIRECTIONAL ZIPPER WITH A DOUBLE SEAL FLANGE PROFILE CONFIGURATION

BACKGROUND OF THE INVENTION

1. Field of the Invention

This invention pertains to a vertical form fill and seal machine, more particularly to the manufacture of reclosable containers or bags by the use of a transverse directional zipper with a double seal flange profile configuration.

2. Description of the Prior Art

In the prior art, it is known to use a form fill and seal machine to manufacture reclosable bags from a roll of film material by mounting transverse directional profile strip fastener assemblies onto the web of film material. It is further well known for the bags to be filled with foodstuffs or similar contents during the manufacturing process. It has been found, however, that the output rate of this manufacturing process may be constrained by the step of mounting of the transverse directional profile strip. More specifically, for a given zipper and film combination at specific seal temperatures and pressures, a minimum dwell time is required to attach a zipper segment to the film. Quite often this dwell time is the limiting factor in the ultimate cycle speed of the apparatus. In other cases, the speed at which the zipper can be delivered to the sealing area is the limiting factor.

The use of a profile strip with fasteners for adjacent bags, that is, the "saddlebag" concept is known. However, to make a "saddlebag" utilizing a zipper on the short side of the package, typically a horizontal form fill and seal machine (HFFS) is used. However, a second piece of equipment is typically required to collect the bags coming off of the machine, and thereafter to orient and seal the tops of the packages together. Similarly, with the use of a vertical form fill and seal machine (VFFS), the print on the web must be adjusted in order to compensate for every other bag being manufactured upside-down. Additionally, the manufacturing process is complicated by seal jaws being adapted to seal the web with and without the zipper profile, on alternate cycles.

Moreover, the registration of the edge of a single zipper with the cut-off knife in a form fill and seal machine has a tolerance of at least one sixteenth of an inch. This can result in the zipper extending into the cut area, causing a poor or incomplete cut, or it can result in the bag film extending above the edge of the zipper either resulting in a multitude of flanges for the consumer to grasp when opening the package or extra bag film being sealed above the zipper and making access to the zipper and its opening features difficult.

U.S. Pat. No. 5,951,453 entitled "Recloseable Bag Assembly and Method of Making Same" issued on Sep. 14, 1999 to Yeager discloses the placing of fastener profiles in adjacent pairs with a common flange. However, the placing of one of the thin elongated profile strips directly on the webbing can require increased complexity in the manufacturing process.

U.S. Pat. No. 4,528,224 entitled "Method of Making Multiple Reclosable Bag Material" issued on Jul. 9, 1985 to Ausnit relates to the fastener profile being applied in the machine direction, rather than the transverse direction, between two rolls of film.

OBJECTS AND SUMMARY OF THE INVENTION

It is therefore an object of this invention to provide a method of form fill and seal manufacture of reclosable bags which has increased manufacturing rates.

It is therefore a further object of this invention to provide a method of form fill and seal manufacture of reclosable bags which uses a plastic strip with adjacent pairs of fastener profiles in the transverse machine direction to provide the fastener profiles for two adjacent bags being manufactured.

It is therefore a still further object of this invention to provide a method of form fill and seal manufacture of reclosable bags which maintains a high degree of registration accuracy.

It is therefore a still further object of this invention to provide a method of form fill and seal manufacture of reclosable bags which accommodates the differences in sealing the upper and lower transverse portions of the reclosable bag.

It is therefore a still further object of this invention to provide the above objects while compensating the printing of the web for every other bag being manufactured upside-down.

It is therefore a final object of this invention to provide the above objects with a minimized requirement for additional equipment.

These and other objects are attained by providing preferably, a vertical form fill and seal device in which segments of a plastic zipper strip are oriented in a transverse direction to the length of a long web and are attached to the center of the web. The length of the segments is slightly less than one half of the width of the web. Each segment of plastic zipper strip includes two adjacent pairs of reclosable zipper profiles on flanges. The zippers are oriented on the strips such that the consumer side of each zipper pair faces the center of the strip and the product side faces the outside edge of the strip.

The strips may be secured to the web just prior to entering the form fill and seal device and fed directly into the form fill and seal device or, alternately, the web with the attached zipper segments is assembled at a site remote from the form fill and seal device and wound back up. At a later time, the rolled up web is put on the form fill and seal machine which forms the web into a tube.

Product is loaded into the tube formed by the web in the form fill and seal device and a seal is made across the tube transverse to the length of the tube (i.e., a cross seal) midway between zipper segments. The cross seal applies two parallel seals, and a knife cuts between the two seals thereby causing the two seals to form the bottoms of two separate bags. The web is indexed, product is filled into the tube and the cross-seal applies two parallel seals across the tube, collapsing the tube and sealing the inner surface of the tube to the exposed side of the zipper segment. A knife cuts between the two seals, and also cuts the zipper in half along its length, these seals and zipper segments thereby forming the tops of two separate bags.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
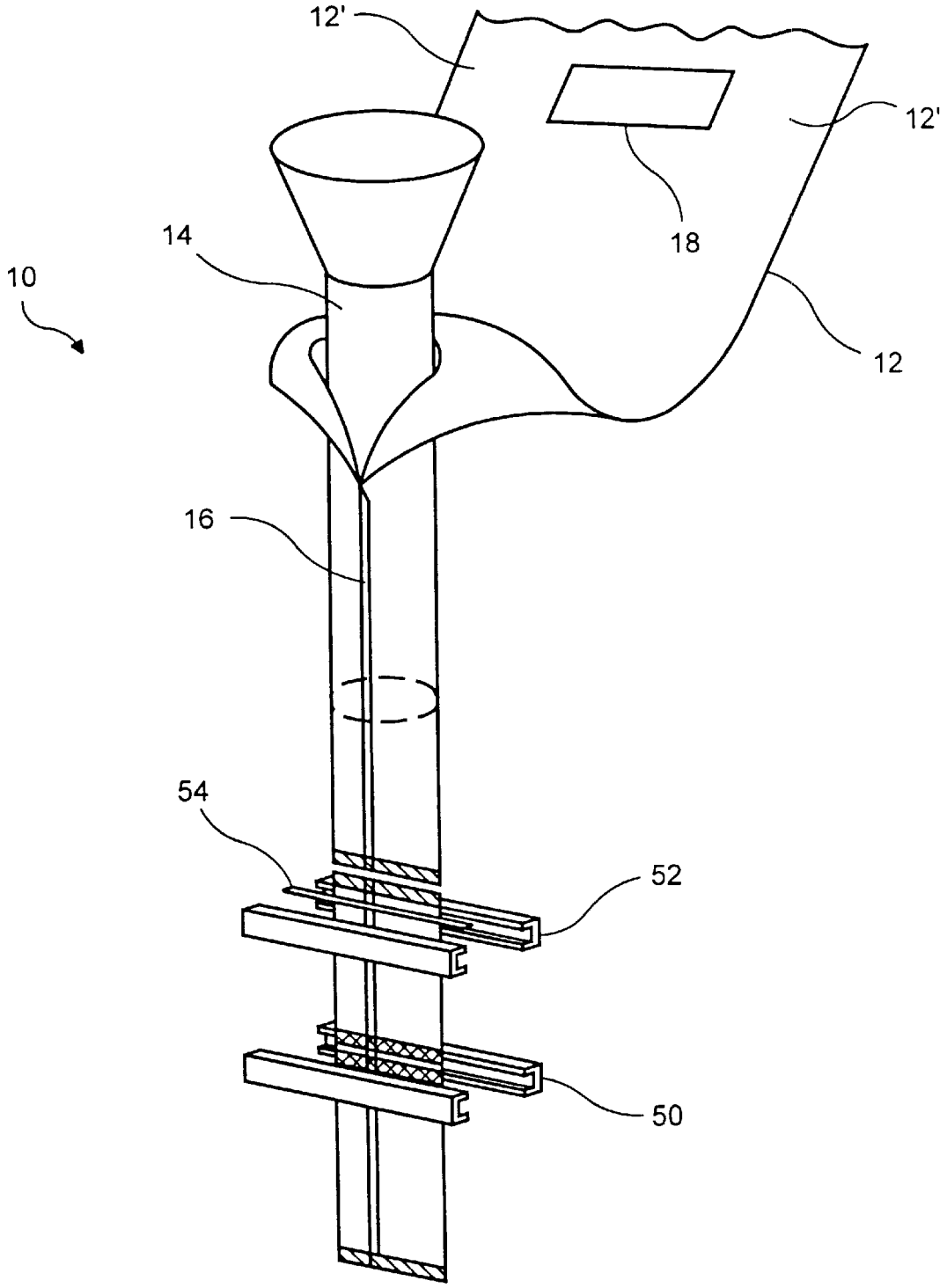
FIG. 1 is a front perspective view of the vertical form fill and seal apparatus used in the method of the present invention.
Figure 2:
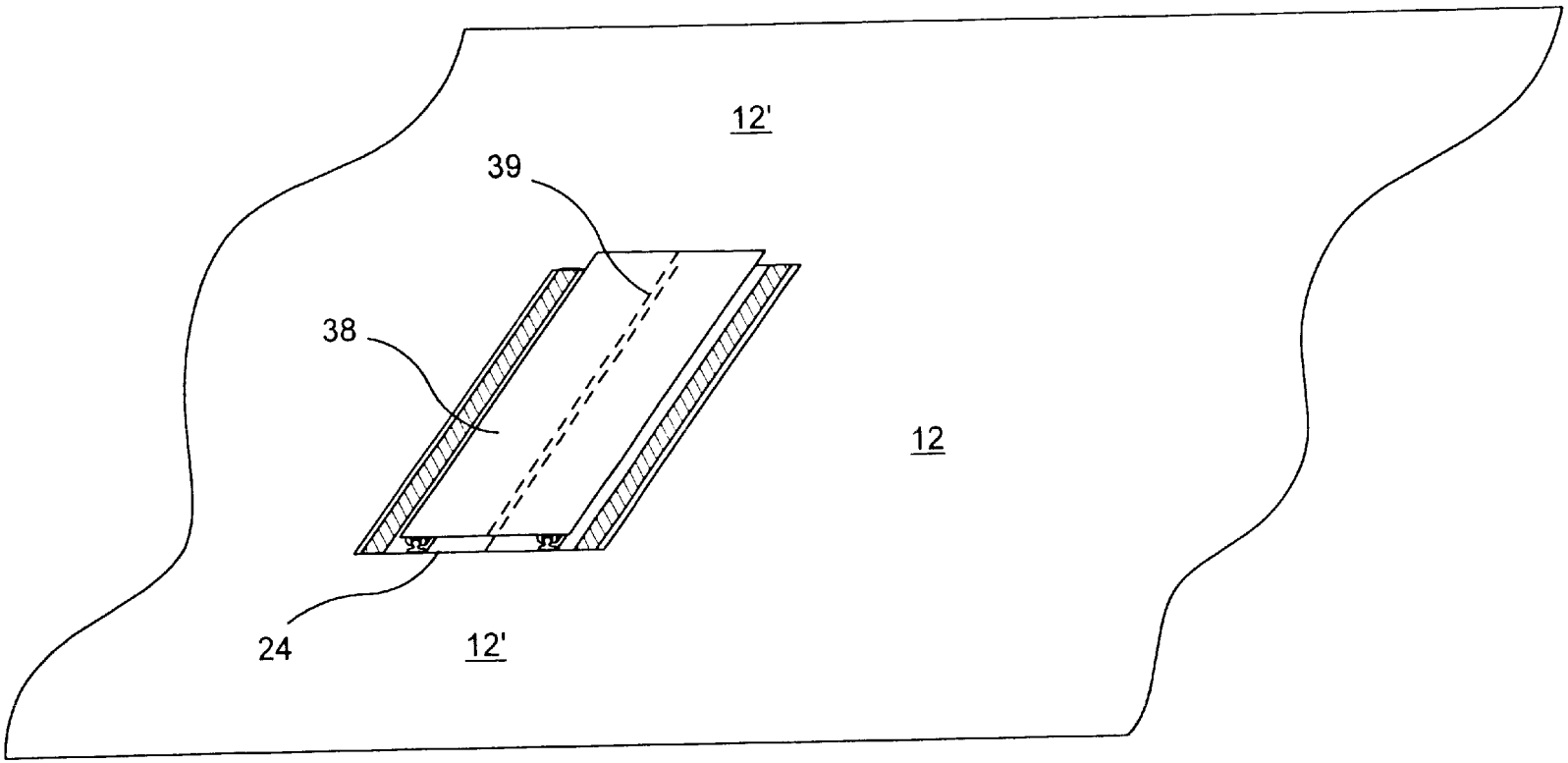
FIG. 2 is a perspective view of the plastic zipper strip oriented in the transverse direction on the web, the strip including two pairs of reclosable zippers.

Referring now to the drawings in detail wherein like numerals refer to like elements throughout the several views, one sees that FIG. 1 is a perspective view of the vertical form fill and seal apparatus 10. Web 12 of film is drawn around tube 14 to a generally cylindrical shape and seam 16 is formed by known methods. Web 12 is supplied to tube 14 with plastic zipper strip 18 with zipper assemblies (see FIGS. 2–5) oriented in a transverse direction to the length of web 12 and attached to the center of the web 12. The length of plastic zipper strips 18 is slightly less than one half of the width of web 12 and substantially equal to one half of the circumference of the cylinder formed by web 12 about tube 14. Each plastic zipper strip 18 includes two reclosable zippers 20, 22 for the formation of the tops of two adjacent reclosable containers, one rightside up, the other upside down. The zippers 20, 22 are oriented on the plastic zipper strip 18 so that the consumer side of each zipper pair is facing the center of the plastic zipper strip 18 and the product side is facing the outside edges of the plastic zipper strip 18. Typically the plastic zipper strips 18 are attached to web 12 prior to supplying web 12 to the vertical form fill and seal apparatus 10. However, the plastic zipper strips 18 could be fastened to web 12 by a process in-line with vertical form fill and seal apparatus 10.

Figure 5:
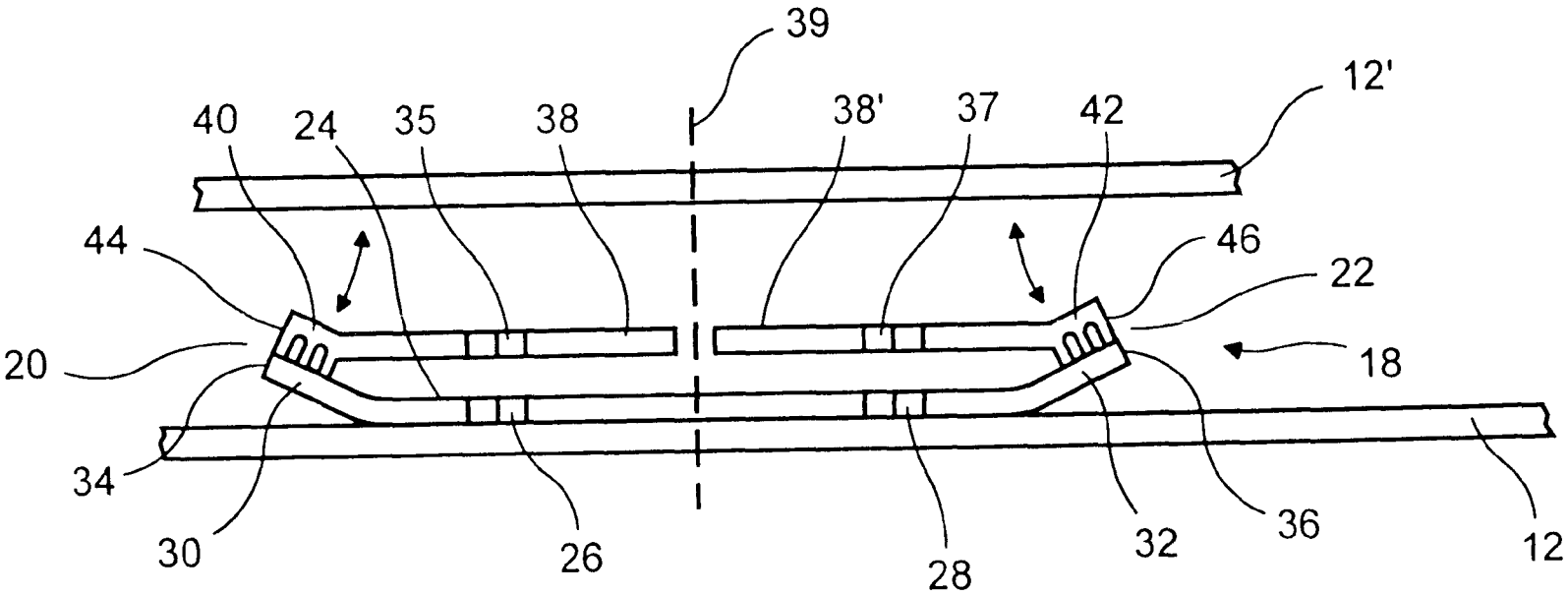
FIG. 5 is a cross-sectional view of the profile of the plastic zipper strips including two pairs of reclosable zippers.

FIG. 5 shows a cross-sectional view of plastic zipper strip 18. First flange 24 is sealed to web 12 along seal lines 26, 28. First lower zipper profile 30 and second lower zipper profile 32 are formed at free ends 34, 36 of first flange 24. Second flange portions 38, 38' are supplied to vertical form fill and seal apparatus 10 free of attachment to web 12 but are thereafter sealed along seal lines 35, 37 to the folded over portions of web 12' formed from the lateral edges of web 12 by lower seal bars 50 (see FIG. 1) and cut 39 is formed to separate the tops of the two resulting reclosable containers. First upper zipper profile 40 and second upper zipper profile 42 are formed at outer ends 44, 46 of second flange portions 38, 38'. First and second lower zipper profiles 30, 32 engage first and second upper zipper profiles 40, 42 thereby forming the reclosable zippers.

Figure 3:
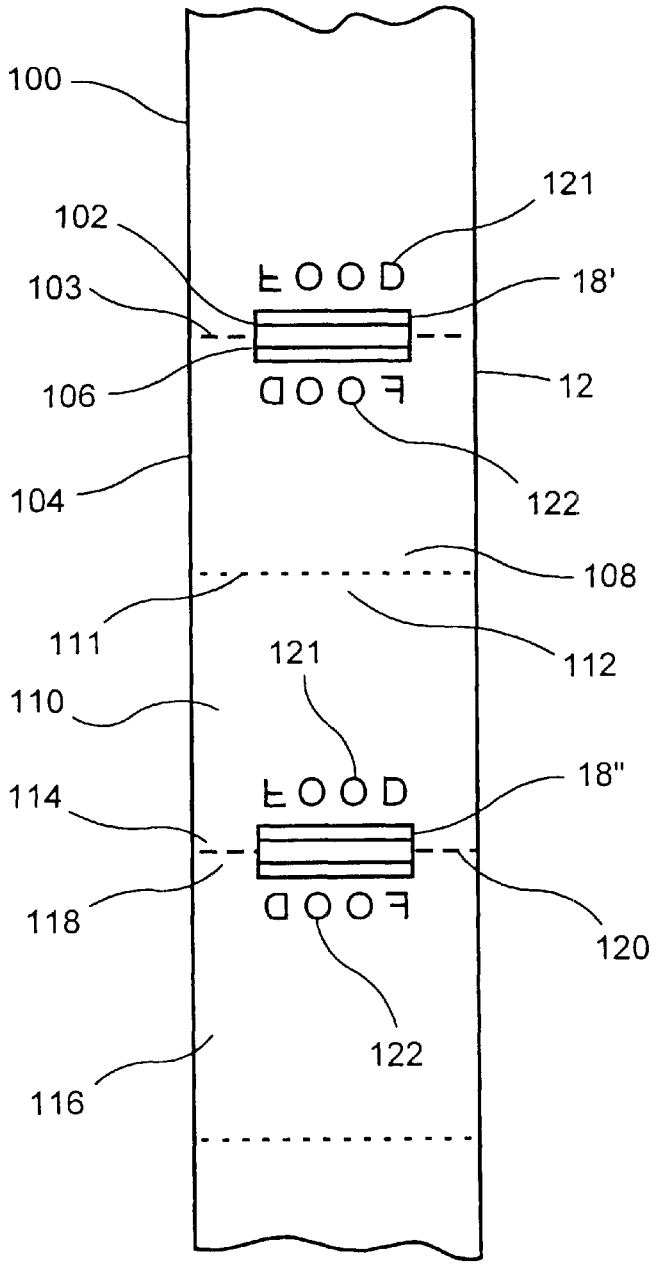
FIG. 3 is a plan view of the web, showing a sequence of the strips including two pairs of reclosable zippers and the relation to the successive reclosable containers formed by the method of the present invention.

As shown in FIG. 3, web 12 is formed into first upside down reclosable container 100 with top 102 adjacent to top 106 of first rightside up reclosable container 104. Top 102 and top 106 each include a zipper from a portion of plastic zipper strip 18'. Seam 103 (also see cut 39 in FIG. 5) is formed through plastic zipper strip 118 to separate first upside down reclosable container 100 from first rightside up reclosable container 104. Bottom 108 of first rightside reclosable container 104 is adjacent to bottom 112 of second upside down reclosable container 110 and separated by seam 111. Top 114 of second upside down reclosable container 110 is adjacent to top 118 of second rightside up reclosable container 116 separated by seam 120. Top 114 and top 118 each include a zipper from plastic zipper strip 18", identical to the relationship between tops 102 and 106 as described above. The sequence of reclosable containers continues successively along web 12.

Figure 4:
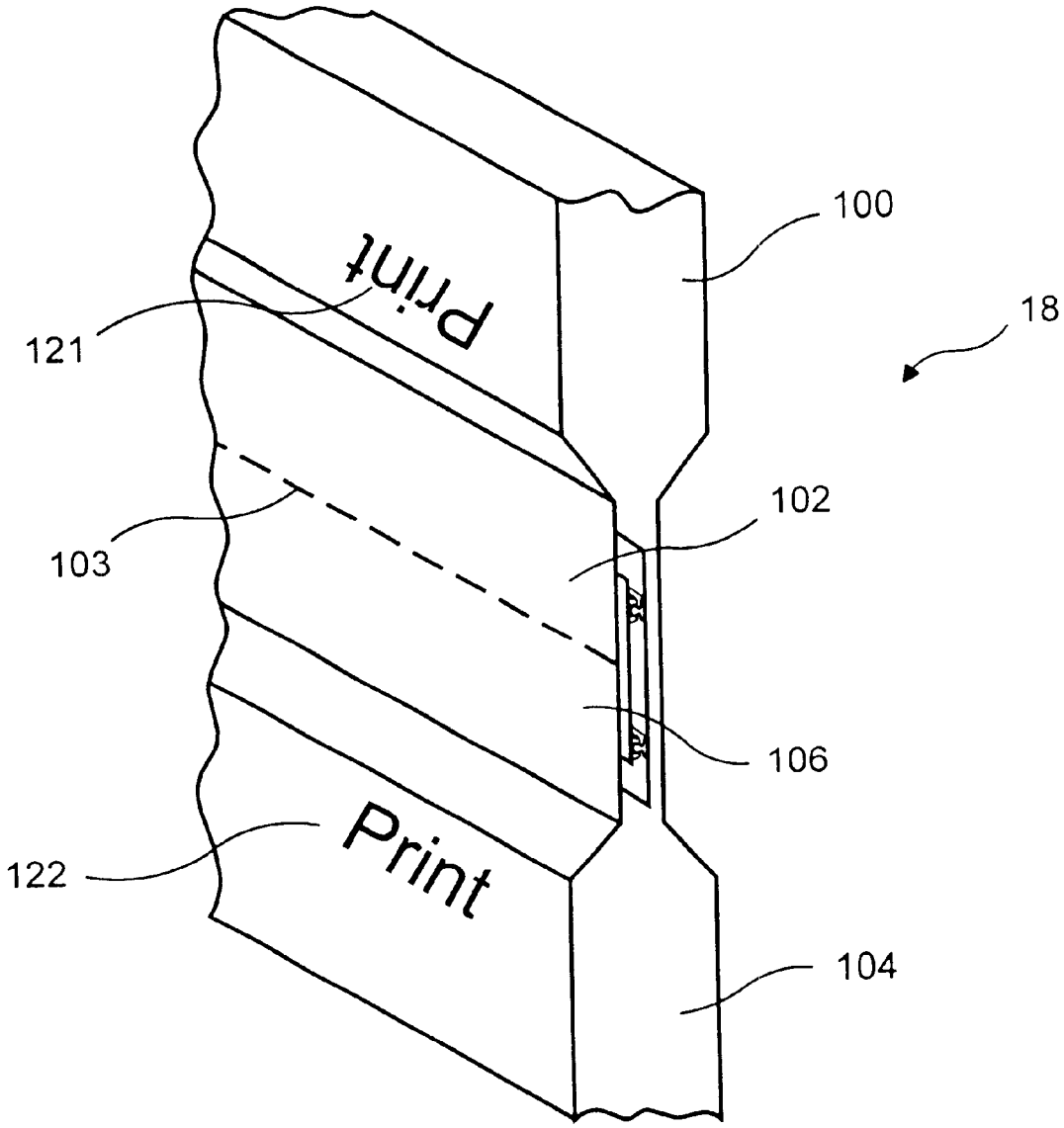
FIG. 4 is a perspective view of the web, including the plastic zipper strips including two pairs of reclosable zippers, illustrating the printing on the web in view of alternate reclosable containers being manufactured upside-down.

As shown in FIGS. 3 and 4, the printing 121 on first and second upside down reclosable containers 100, 110 is upside down and reversed with respect to printing 122 on first and second rightside up reclosable containers 104, 116 in order to properly compensate for the manufacture of adjacent pairs of an upside down reclosable container and a rightside up reclosable container.

As shown in FIG. 1, upper seal bars 52 are used to seal web 12 to web 12' at two closely spaced parallel transverse sections thereby forming the bottom of two adjacent reclosable packages. Optionally, lower and upper seal bars 50, 52 may be combined. Blade 54 is used to separate the bottoms of the two adjacent reclosable packages thereby allowing the lower upside down reclosable package (which previously has had its upper seal area formed and has been filled with product) to become free of the web and continue as a completed package. The rightside up reclosable package is then indexed so that the plastic zipper segment 18 is between lower seal bars 50. Product is dispensed from tube 14 into the rightside up reclosable package and lower seal bars 50 apply two parallel seals thereby forming the tops of rightside up reclosable package and a subsequent upside down reclosable package, collapsing the tube formed by web 12 and 12' and sealing the inner surface of the tube to the exposed side (i.e., second flange portions 38, 38' of FIG. 5) of plastic zipper segment 18. A blade within lower seal bars 50 then cuts along cut 39 (see FIG. 5) thereby allowing the rightside up bag to become free of the web and continue as a completed package. Product is then dispensed from tube 14 to the subsequent upside down reclosable package and the cycle continues with upper seal bars 52 sealing subsequent upside down reclosable package and blade 54 cutting subsequent upside down reclosable package free of web 12 resulting in a "saddle bag" configuration wherein two bags are at least temporarily connected by their respective tops.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A method of making reclosable containers, comprising the steps of:

providing a web of film material;

providing a plurality of zipper assemblies, each of said zipper assemblies including a first flange with a pair of first spaced apart zipper profiles thereon and a second flange with a pair of second spaced apart zipper profiles thereon, wherein each of said first zipper profiles reclosably engage one of said second zipper profiles;

sealing said first flanges to said web in a transverse direction;

folding said web and sealing lateral edges of said web to each other thereby forming at tube;

sealing folded portions of said web to said second flange;

forming two closely spaced adjacent transverse seals in said tube substantially half way between said zipper assemblies; and severing said tube transversely along a substantial mid-point of said first flange between said zipper assemblies thereby forming tops of two adjacent reclosable containers, including a rightside up reclosable container and an upside down reclosable container.

2. The method of claim 1 further including the step of severing said tube between said two closely spaced adjacent transverse seals thereby forming bottoms of a rightside up reclosable container and an upside down reclosable container.

3. The method of claim 2 wherein said step of forming two closely spaced adjacent transverse seals and said step of severing said tube between said two closely spaced adjacent transverse seals is performed simultaneously by a first set of sealing bars.

4. The method of claim 3 wherein said step of sealing folded portions of said web to said second flange and said step of severing said tube transversely along said substantial midpoint of said first flange is performed simultaneously by a second set of sealing bars.

5. The method of claim 4 wherein said step of forming two closely spaced transverse seals is preceded by a step of providing contents to said upside down reclosable container.

6. The method of claim 5 wherein said step of sealing folded portions of said web to said second flange is preceded by a step of providing contents to said rightside up reclosable container.

7. The method of claim 6 further including the step of printing alternately upside down and rightside up on said web of said upside down reclosable container and said rightside up reclosable container so that the resulting printing on said upside down reclosable container and said rightside up reclosable container are substantially identical when said rightside up reclosable container and said upside down reclosable container are positioned in like configurations.

* * * * *